United States Patent [19]

Burke

[11] 4,026,339

[45] May 31, 1977

[54] HANDBAG PROTECTION

[76] Inventor: Ann M. Burke, 5547 S. Sacramento, Chicago, Ill. 60629

[22] Filed: Apr. 15, 1976

[21] Appl. No.: 677,238

[52] U.S. Cl. ..... 150/28 R

[51] Int. Cl.[2] ..... A45C 3/06

[58] Field of Search ..... 150/28 R, 28 A, 35, 150/52 R; 190/42, 26

[56] References Cited

UNITED STATES PATENTS

| | | | |
|---|---|---|---|
| 1,560,223 | 11/1925 | Englander | 150/28 R |
| 1,562,408 | 11/1925 | Berkowitz | 150/28 A |
| 2,093,097 | 9/1937 | Potash | 150/28 A |
| 2,436,237 | 2/1948 | Brandt | 150/52 R |
| 2,540,165 | 2/1951 | Fiel | 190/42 |
| 2,784,756 | 3/1957 | Resnick | 150/28 A |
| 3,901,360 | 8/1975 | Cook | 150/52 R X |

*Primary Examiner*—Donald F. Norton
*Attorney, Agent, or Firm*—Allen D. Brufsky

[57] ABSTRACT

A covering to protect a handbag and its contents from the rain or the like. The covering is a vinyl sheet sewn to the handbag and stored within a pouch on an exterior panel thereof. When in use, the sheet is unfolded and wrapped around the bag.

3 Claims, 2 Drawing Figures

HANDBAG PROTECTION

BACKGROUND OF THE INVENTION

This invention relates to a protective covering for a ladies' handbag.

Ladies' handbags are often made from expensive cloth materials, velvet or the like which when exposed to rain are soaked and ruined. Further, water or dust can leak through the separable parts of the handbag to ruin the contents carried therein.

SUMMARY OF THE INVENTION

Accordingly, this invention provides an integral, protective cover for a handbag carried within a pouch on the bag. The protective covering includes a vinyl sheet sewn to the pouch which can be folded and stored within the panels when not in use, but when needed to protect the bag from the elements, can be unfolded and wrapped around the handbag.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 2:
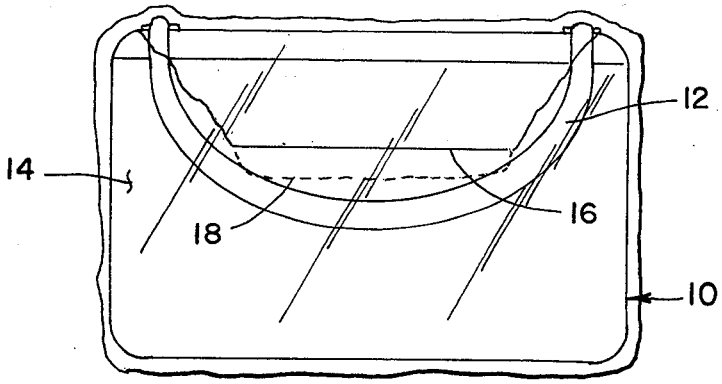
FIG. 2 is a side view in elevation similar to FIG. 1 with the protective covering wrapped around the handbag to protect it.

Referring now in detail to the drawing, wherein like numerals indicate like elements throughout the several views, a ladies' handbag 10 provided with a pivotable handle 12 can be protected from rain or dust by a vinyl covering or the like 14 wrapped around bag 10 and handle 12 as shown in FIG. 2.

Handbag 10 includes a pouch 16 of cloth or material compatible with the rest of bag 10 sewn by stitches 18 to the front panel of bag 10. Stitched by stitches 18 to the interior of pouch 16 is the vinyl covering 14, which is folded and stored within pouch 16 when not in use.

Figure 1:
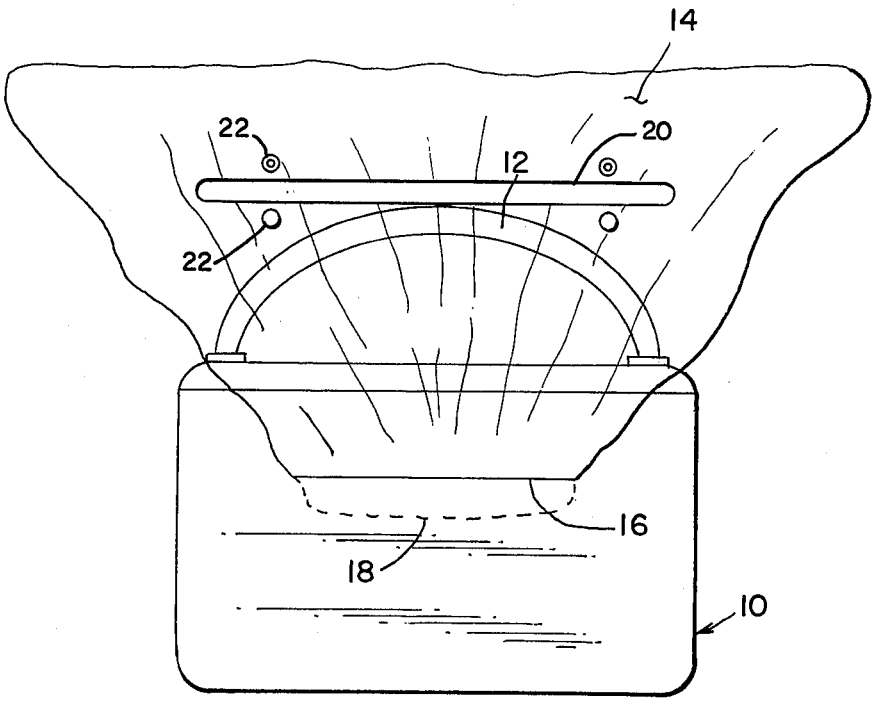
FIG. 1 is a side view in elevation of a handbag provided with a protective covering of the present invention.

When needed, covering 14 is removed from pouch 16, as shown in FIG. 1, and unfolded. Handle 12 is pivoted to a position shown in FIG. 2, wherein it lies flat against bag 10. Covering 14 is then wrapped about bag 10 to protect its exterior and to prevent leakage of water to its interior. Bag 10 can be carried under the arm of the user.

If desired, vinyl covering 14 can be provided with a slot 20 to receive handle 12 therethrough so bag 10 can be covered and still be carried by handle 12. The covering 14 can be provided with snap fasteners 22 adjacent both sides of the slot 20 to cover the top of bag 10 to prevent leakage through the separable halves joined by a clasp at the top.

I claim:

1. In combination with a handbag, a pouch attached to a side panel thereof, and a covering for said handbag secured to said handbag within said pouch adapted to be stored in folded condition within said pouch when not in use and unfolded and wrapped about said handbag when necessary to cover and protect said handbag, said pouch and covering being sewn to the side panel of said handbag, and said covering having a portion disposed within said pouch and including a slot for receiving a handle connected to said handbag.

2. The combination of claim 1 including a plurality of fastening elements on said covering on opposite sides of said slot.

3. The combination of claim 2 wherein said fastening elements are snap fasteners.

* * * * *